US008587607B2

(12) United States Patent
Graf et al.

(10) Patent No.: US 8,587,607 B2
(45) Date of Patent: Nov. 19, 2013

(54) METHOD FOR PRODUCING A REPRESENTATION OF A PIXEL GRAPHIC ON A DISPLAY

(75) Inventors: Oliver Graf, Erlangen (DE); Martin Herget, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 1035 days.

(21) Appl. No.: 12/588,750

(22) Filed: Oct. 27, 2009

(65) Prior Publication Data

US 2010/0103190 A1 Apr. 29, 2010

(30) Foreign Application Priority Data

Oct. 28, 2008 (DE) ..... 10 2008 053 452

(51) Int. Cl.
*G09G 5/02* (2006.01)

(52) U.S. Cl.
USPC ..... 345/600; 715/762

(58) Field of Classification Search
USPC ..... 345/600; 715/762
See application file for complete search history.

(56) References Cited

U.S. PATENT DOCUMENTS

| | | | | |
|---|---|---|---|---|
| 5,140,676 | A * | 8/1992 | Langelaan | 715/210 |
| 5,371,844 | A * | 12/1994 | Andrew et al. | 715/747 |
| 5,867,169 | A * | 2/1999 | Prater | 345/604 |
| 6,624,828 | B1 * | 9/2003 | Dresevic et al. | 715/771 |
| 7,532,216 | B2 | 5/2009 | Wendel et al. | |
| 2005/0206656 | A1 | 9/2005 | Cooper | |
| 2008/0303825 | A1 * | 12/2008 | Clegg et al. | 345/471 |

FOREIGN PATENT DOCUMENTS

EP 1729262 A2 12/2006

OTHER PUBLICATIONS

Bernd Held, Dilek Mersin: Windows 2000—The bhv Pocket Guide, moderne Industrie Buch, (c) 2000-2002, ISBN 3-8266-8010-3, pp. 4-40 (Full Translation Provided).

* cited by examiner

*Primary Examiner* — Maurice L McDowell, Jr.
(74) *Attorney, Agent, or Firm* — Harness, Dickey & Pierce, P.L.C.

(57) ABSTRACT

Pixel graphics resulting from a computer program running under an operating system are to be tailored to the environment. According to an embodiment of the invention, it is assumed that a user sets settings for graphic interfaces, which the operating system itself produces, so that the graphic interfaces are tailored to the environment and makes the determination of the pixel graphic a function of data stored during such setting of the graphic interfaces.

16 Claims, 1 Drawing Sheet

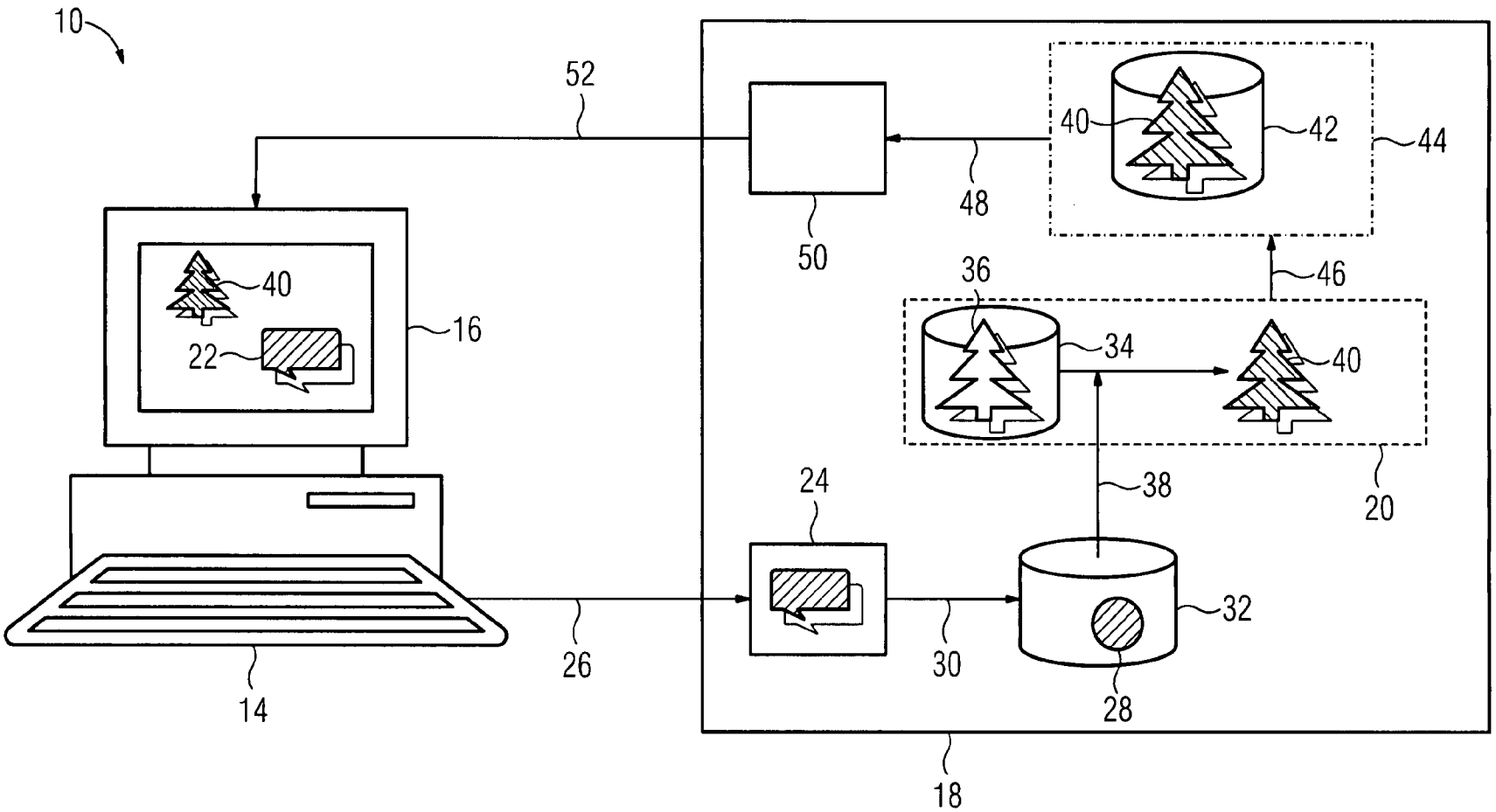
10
14
16
18
20
22
24
26
28
30
32
34
36
38
40
42
44
46
48
50
52

METHOD FOR PRODUCING A REPRESENTATION OF A PIXEL GRAPHIC ON A DISPLAY

PRIORITY STATEMENT

The present application hereby claims priority under 35 U.S.C. §119 on German patent application number DE 10 2008 053 452.8 filed Oct. 28, 2008, the entire contents of which are hereby incorporated herein by reference.

FIELD

At least one embodiment of the invention generally relates to a method for producing a representation on a display apparatus. In least one embodiment, the display apparatus is to be actuated in a manner known per se by a computer system by way of control commands. Such control commands are produced in particular by an operating system provided to control the computer system. Such an operating system allows a user to select a setting, which describes at least one characteristic of certain graphic interfaces produced by the operating system. Typically at least one data item is stored for each selected setting, with an information data item being intended in the present instance. The setting data item is typically provided in the form of a conventional data value.

At least one embodiment of the invention generally relates to the field of computer programs, in particular those running (or operating) under an operating system. When a computer program runs under an operating system the operating system causes graphic interfaces to be produced, the characteristics of which are determined by the operating system itself. With the operating system Microsoft Vista® the operating system produces frames for windows for example and the configuration of the frames is defined by the operating system or the settings set in the operating system.

BACKGROUND

In the case of a computer program running under an operating system however graphics are also defined by the computer program itself and simply transferred to the operating system, which then does not influence the graphics further but causes the graphics to be represented on a display apparatus by way of control commands to the display apparatus. Some computer programs allow settings governing how such graphics are represented to be selected. However this selection option is not standard.

Different graphic configurations may be necessary depending on the environment of the display apparatus. In a clinical environment there is for example a very bright working environment in a reception area where patients are booked in. The reception area is comparable to an office area. Screens in the office area typically have a luminance of 120 cd/m$^2$. However so-called diagnostic work stations are also present in the clinical environment. The German x-ray ordinance requires a dark environment for these. In contrast screens at diagnostic work stations should have a luminance of 400 cd/m$^2$.

Comparing these two extremes highlights a general need to tailor the representation of graphics to the environment of a display apparatus on which they are represented. Depending on the environment a certain brightness may be required for the graphic, a certain contrast may be advantageous and certain color values may also be particularly easily visible to the human eye.

It would be desirable for it to be possible to tailor the characteristics of graphic elements produced by a computer program operating under an operating system and displayed on a display apparatus to ambient conditions in a variable manner.

SUMMARY

In at least one embodiment of the invention, a way is shown in which graphic representations can be tailored with greater probability to ambient conditions by way of computer programs.

A method and/or a data carrier may allow, in at least one embodiment, the execution of the inventive method. The inventive method of at least one embodiment can operate on a computer system.

According to at least one embodiment of the invention the computer program running under the operating system reads out the at least one data item, which is stored for a setting set by a user. The computer program running under the operating system uses this at least one data item to determine a pixel graphic (e.g. in bit map format, a jpg pixel graphic or a gif pixel graphic etc.). The pixel graphic is transferred by the computer program to the operating system, which then causes the pixel graphic to be represented on the display apparatus by way of control commands to the display apparatus.

At least one embodiment of the invention assumes that a user sets settings in relation to the operating system such that the graphic interfaces are tailored optimally to ambient conditions. Even if the computer program running under the operating system produces pixel graphics which have nothing to do with the graphic interfaces produced by the operating system, it takes into account the characteristics of these graphic interfaces determined by the user according to the environment when determining the pixel graphic. It is thus possible to configure the pixel graphic and the graphic interfaces in an appropriate manner for the environment.

In one particularly simple instance the computer program selects the pixel graphic to be transferred from a plurality of pixel graphics as a function of the at least one data item. This instance is particularly expedient, if the settings for the graphic interfaces are also set by selecting from a menu. It is then possible to produce a specific variant of a pixel graphic for each type of representation of the graphic interfaces, which the computer program can call up later.

Advanced operating systems allow graphic interfaces to be determined precisely, e.g. the contrast can be adjusted infinitely or in extremely small stages and a slider can be used to determine a color value or brightness. In such instances the at least one data item comprises a numerical value. It is not the case now that this numerical value has to be adopted directly for the pixel graphic determined by the computer program. For example the numerical value can relate to the brightness of a blue tone even though a red tone is provided for the pixel graphic.

It is however possible to assign the numerical value for a corresponding numerical value to the pixel graphic, if it provides a basic form for this pixel graphic. Assignment includes specifying a mathematical formula. The computer program can then access this basic form and use the numerical value to calculate the pixel graphic to be transferred from the basic form according to the predetermined mathematical formula. The mathematical formula can be determined such that, if the settings set by the user and therefore the representation of graphic interfaces by the operating system are optimized, the pixel graphic supplied by the computer program running under the operating system is also tailored optimally to the environment.

To refine the last-mentioned embodiment there are a plurality of basic forms, from which the computer program makes a selection likewise as a function of the at least one data item. For example modifications of a basic form can expediently be used for the pixel graphic to be produced up to a certain ambient brightness, which is concluded from the numerical value in the setting data item, it being possible however for a contrast reversal to prove expedient above a certain brightness. It is not necessary for the graphic interfaces themselves to show this contrast reversal but the computer program running under the operating system can use different representation principles from the operating system.

Typically the at least one numerical value indicates a color tone value, a brightness and/or a contrast. These are the three variables used by standard operating systems, which can therefore also be determined in these. Conversely provision can also be correspondingly made for a color tone value, a brightness and/or a contrast to be calculated from the at least one numerical value for the pixel graphic. There is typically a mathematical formula linking the color tone value for the graphic interfaces produced by the operating system and the color tone value the computer program produces under the operating system and similarly therefore are mathematical formulae linking the brightness of the graphic interfaces and the brightness of the pixel graphic and linking the contrast of the graphic interfaces and the contrast of the pixel graphic.

The numerical values do not have to be the same for this mathematical formula; the formula does not have to contain linear mapping but can be tailored optimally to the basic form of the pixel graphic.

Classic examples of a pixel graphic produced by a computer program are pictorial markings and pictograms. While conventionally only a single basic graphic is used for these, in the present instance this is tailored to the settings of the operating system, if the pixel graphic relates to or shows a pictogram.

The storage location of the data item read out by the computer program running under the operating system is not of significance for the invention. Current operating systems store such data items in text files; there is frequently a single such text file for an operating system, in which all the settings are stored, with the inputs in the text file being modified when a user changes the settings.

The computer program running under the operating system and the operating system generally communicate in that data is written to a storage unit by the one program and then read out by the other program. The pixel graphic is thus preferably transferred to the operating system by the computer program storing the pixel graphic in a storage region of a storage unit and the operating system then reading it out of the storage region. The invention can also then be used when data is transferred from computer programs to the operating system in a different manner so that there is a representation on a display apparatus.

A program code for executing a computer program is stored on the inventive data carrier and is designed to run under a predetermined operating system. On execution by a data processing unit it reads out setting data stored for the operating system and uses at least one such read out setting data item to determine a pixel graphic, to transfer this to the operating system for representation on a display apparatus.

At least one pixel graphic is preferably stored for the program code and the computer program is designed to calculate a pixel graphic taking into account a setting data item read out from the stored pixel graphic during its execution by a data processing unit. A number of pixel graphics can also be stored for the program code and a selection can be made based on the read out setting data item. In some instances a selection is made and calculation is based on the selected pixel graphic.

At least one embodiment of the inventive computer system has executable operating system files for producing control commands to a display apparatus connected to the computer system, with a setting data item being stored in at least one operating system file, often typically a simple text file. During their execution (i.e. the execution for example of an .exe file from the operating system files) the operating system files should permit modification of the stored setting data item in the at least one operating system file (i.e. in particular the text file). The computer system also comprises executable computer program files, which during their execution (i.e. in particular during execution of the associated .exe file) cause at least one setting data item to be read out from at least one operating system file, a pixel graphic to be determined as a function of at least one read out setting data item and to be stored in a storage region of a storage unit of the computer system, which the executed operating system files access to bring about a display of the pixel graphic on a display apparatus connected to the computer system by way of the executed operating system files.

BRIEF DESCRIPTION OF THE DRAWINGS

An example embodiment of the invention is described in more detail below with reference to the drawing, in which FIG. 1 shows a schematic diagram of the execution of an embodiment of the inventive method.

DETAILED DESCRIPTION OF THE EXAMPLE EMBODIMENTS

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

A computer unit identified as a whole as 10 includes the actual computer system 12, which can be operated by way of a human-machine interface 14. In the present instance a keyboard is shown as the human-machine interface 14 but a computer mouse or another human-machine interface can be alternatively or additionally provided. The computer system 12 is connected to a screen 16. The computer system 12 runs by way of an operating system 18, under which at least one further computer program 20 runs. The data flow occurring in the context of the invention is shown schematically in FIG. 1.

The operating system 18 produces the control commands to the screen 16. The operating system 18 has defined graphic interfaces, shown in FIG. 1 by the symbol 22. In the case of the known operating system Microsoft Vista® such graphic interfaces are for example windows, in which content is displayed.

The operating system 18 now allows inputs to be made by way of the human-machine interface 14, in particular settings relating to the characteristics of the graphic interfaces 22. To this end a mask 24 can be opened and a characteristic of the graphic interface 22 can be selected by way of the human-machine interface 14, as shown by the arrow 26. In the mask 24 it is possible to select for example from the names of basic types for the graphic interface 22. To some extent masks 24 also allow the determination of data values, e.g. a contrast, a color tone value or a brightness, perhaps by way of a slider. After the setting has been selected in the mask 24, a data item 28 is written into a file 32 according to the arrow 30. In FIG. 1 the data item is shown simply as a circle with a pattern. This corresponds symbolically to the selection of a certain basic form for the graphic interfaces. The data item 28 can however also be a simple numerical value for color tone value, contrast or brightness.

An embodiment of the invention now relates to the representation of pixel graphics based on commands produced by the computer program 20. There is a file 34 for the computer program 20, in which a basic form 36 of a pixel graphic is stored. The computer program 20 now reads the data item 28 out of the file 32 according to the arrow 38 and produces a variant of the basic graphic 36 stored in the file 34 as a function of the data item 28. This variant is shown as 40 in FIG. 1. The variant 40 can be produced based on a tabular assignment; it can be determined that the pattern shown in FIG. 1 for the data item 28 always causes the pattern shown for the variant 40 in FIG. 1 to be used. The representation with patterns should however be understood as essentially symbolic. In particular a numerical value, which describes characteristics of the pixel graphic 40, can be calculated as a function of the data item 28, if this also represents a numerical value. The numerical value can relate to the color tone, the contrast and the brightness. A number of such numerical values can also be calculated independently of one another, in particular if a number of corresponding data values are present as a data item, like the data item 28 in the file 32.

The computer program 20 cannot actuate the screen 16 itself. Instead it transfers the pixel graphic 40 to the operating system 18, in that it stores it in a storage region 42 of a storage unit marked as a whole with 44 according to the arrow 46. The operating system 18 accesses the storage region 42 and reads the pixel graphic 40 out according to the arrow 48, with a computer program module 50 of the operating system 18 producing the actual actuation commands to the screen 16 according to the arrow 52. The pixel graphic 40 is then represented on the screen as the computer program 20 has determined. The operating system 18 does not influence this pixel graphic 40.

The method can be configured so that, if a user determines the characteristics of the graphic interface 22 in an appropriate manner for certain ambient conditions, in particular the brightness in the room where the screen 16 is set up, the pixel graphic 40 is also tailored precisely to these ambient conditions.

The graphic representation of elements, which result from the computer program 20, is linked by an embodiment of the invention to the graphic representation of graphic interfaces 22 by the operating system 18.

List Of Reference Characters

10 Computer unit
12 Computer system
14 Keyboard

16 Screen
18 Operating system
20 Computer program
22 Symbol
24 Mask
26, 30, 38, 46, 48,
52 Arrows showing data flow
28 Data item
32, 34 Files
36 Basic form
40 Variant of basic form 36
42 Storage region
44 Storage unit
50 Computer program module The patent claims filed with the application are formulation proposals without prejudice for obtaining more extensive patent protection. The applicant reserves the right to claim even further combinations of features previously disclosed only in the description and/or drawings.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combineable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims. Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, computer readable medium and computer program product. For example, of the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable medium and is adapted to perform any one of the aforementioned methods when run on a computer device (a device including a processor). Thus, the storage medium or computer readable medium, is adapted to store information and is adapted to interact with a data processing facility or computer device to execute the program of any of the above mentioned embodiments and/or to perform the method of any of the above mentioned embodiments.

The computer readable medium or storage medium may be a built-in medium installed inside a computer device main body or a removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, including but not limited to floppy disks (trademark), cassette tapes, and removable hard disks; media with a built-in rewriteable non-volatile memory, including but not limited to memory cards; and media with a built-in ROM, including but not limited to ROM cassettes; etc. Furthermore, various information regarding stored images, for example, property information, may be stored in any other form, or it may be provided in other ways.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for producing a representation on a display apparatus, actuated by a computer system by way of control commands, with an operating system provided to control the computer system producing the control commands and allowing a user to select a setting which describes at least one characteristic of certain graphic interfaces produced by the operating system, at least one data element being stored to define the respectively selected setting, the method comprising:

reading out, via a computer program running under the operating system, the at least one data element;

using, via the computer program, the at least one data element to determine a pixel graphic by selecting the pixel graphic, from a plurality of pixel graphics, as a function of the at least one data element;

transferring the determined pixel graphic to the operating system; and causing, via the operating system, the pixel graphic to be represented on the display apparatus by way of control commands to the display apparatus.

2. The method as claimed in claim 1, wherein at least one of a color tone value, a brightness and a contrast is calculated for the pixel graphic from the numerical value.

3. The method as claimed in claim 1, wherein the pixel graphic relates to a pictorial marking or a pictogram.

4. The method as claimed in claim 1, wherein the operating system stores the at least one data element in a text file.

5. The method as claimed in claim 1, wherein the pixel graphic is transferred to the operating system by the computer program storing the pixel graphic in a storage region of a storage unit and the operating system then reading the pixel graphic out from the storage region.

6. A non-transitory computer readable medium including program segments for, when executed on a computer device, causing the computer device to implement the method of claim 1.

7. A non-transitory data carrier including a program code stored thereon for executing a computer program, the computer program designed to run under an operating system, which when executed by a data processing unit, causes the data processing unit to perform functions including:

reading out at least one setting data element stored for the operating system, determining a pixel graphic using the at least one read out setting data element, and transferring the pixel graphic to the operating system for representation on a display apparatus, wherein at least one pixel graphic is stored for the program code and the computer program is designed, during the execution by the data processing unit, to calculate the pixel graphic by taking into account the setting data element read out from the stored pixel graphic.

8. A computer system with executable operating system files for producing control commands to a display apparatus connected to the computer system, the operating system files including a setting data element stored in at least one of the operating system files and including at least one operating system file permitting modification of the stored setting data element during an execution of the operating system files, the computer system also including executable computer program files, which when executed, performs the following function:

reading out at least one setting data element, determining a pixel graphic as a function of at least one read out setting data element, storing the pixel graphic in a storage region of a storage unit of the computer system, and displaying the pixel graphic on the display apparatus connected to the computer system, wherein the executable computer program files determine the pixel graphic by, selecting the pixel graphic from a plurality of pixel graphics as a function of the at least one read out setting data element, and calculating the pixel graphic from the stored pixel graphic as a function of the at least one read out setting data element.

9. A method for producing a representation on a display apparatus, actuated by a computer system by way of control commands, with an operating system provided to control the computer system producing the control commands and allowing a user to select a setting which describes at least one characteristic of certain graphic interfaces produced by the operating system, at least one data element being stored to define the respectively selected setting, the method comprising:

reading out, via a computer program running under the operating system, the at least one data element;

using, via the computer program, the at least one data element to determine a pixel graphic, wherein the at least one data element has a numerical value, and the computer program accesses the pixel graphic in a basic form and calculates the pixel graphic to be transferred from the basic form using the numerical value according to a mathematical formula;

transferring the determined pixel graphic to the operating system; and causing, via the operating system, the pixel graphic to be represented on the display apparatus by way of control commands to the display apparatus.

10. The method as claimed in claim 9 wherein the computer program selects the basic form of the pixel graphic from a plurality of pixel graphics as a function of the at least one data element.

11. The method as claimed in claim 10, wherein the numerical value relates to at least one of a color tone value, a brightness and a contrast.

12. The method as claimed in claim 10, wherein at least one of a color tone value, a brightness and a contrast is calculated for the pixel graphic from the numerical value.

13. The method as claimed in claim 9 wherein the numerical value relates to at least one of a color tone value, a brightness and a contrast.

14. The method as claimed in claim 13, wherein at least one of a color tone value, a brightness and a contrast is calculated for the pixel graphic from the numerical value.

15. A non-transitory data carrier including a program code stored thereon for executing a computer program, the computer program designed to run under an operating system, which when executed by a data processing unit, causes the data processing unit to perform functions including:

reading out at least one setting data element stored for the operating system, determining a pixel graphic using the at least one read out setting data element, and transferring the pixel graphic to the operating system for representation on a display apparatus, wherein the computer program determines the pixel graphic by selecting the pixel graphic to be transferred from a plurality of pixel graphics as a function of the at least one setting data element.

16. A computer system with executable operating system files for producing control commands to a display apparatus connected to the computer system, the operating system files including a setting data element stored in at least one of the operating system files and including at least one operating system file permitting modification of the stored setting data element during an execution of the operating system files, the computer system also including executable computer program files, which when executed, performs the following function:

reading out at least one setting data element having a numerical value, determining a pixel graphic as a function of at least one read out setting data element, storing the pixel graphic in a storage region of a storage unit of the computer system, and displaying the pixel graphic on the display apparatus connected to the computer system, wherein the executable computer program files determine the pixel graphic by, selecting the pixel graphic from a plurality of pixel graphics as a function of the at least one read out setting data element, accessing the pixel graphic in a basic form, and calculating the pixel graphic using the numerical value according to a mathematical formula.

* * * * *

UNITED STATES PATENT AND TRADEMARK OFFICE

CERTIFICATE OF CORRECTION

PATENT NO. : 8,587,607 B2
APPLICATION NO. : 12/588750
DATED : November 19, 2013
INVENTOR(S) : Oliver Graf It is certified that error appears in the above-identified patent and that said Letters Patent is hereby corrected as shown below:

On the Title Page, Item (54) and in the Specification, Column 1, lines 1-3, Title should read -- METHOD FOR PRODUCING A REPRESENTATION OF A PIXEL GRAPHIC ON A DISPLAY APPARATUS --

Signed and Sealed this
Twenty-fifth Day of February, 2014

Michelle K. Lee

Michelle K. Lee
*Deputy Director of the United States Patent and Trademark Office*